US011006667B2

(12) United States Patent
Fornarelli

(10) Patent No.: US 11,006,667 B2
(45) Date of Patent: May 18, 2021

(54) ASSEMBLY FOR PROVIDING CHEMICALS FOR SMOKELESS ADMINISTRATION, A DISPOSABLE TANK, AND A METHOD OF USING THE SAME

(71) Applicant: AVANZATO TECHNOLOGY CORP., Chicago, IL (US)

(72) Inventor: Thomas Fornarelli, Chicago, IL (US)

(73) Assignee: 14TH ROUND INC., Los Angeles, CA (US)

( * ) Notice: Subject to any disclaimer, the term of this patent is extended or adjusted under 35 U.S.C. 154(b) by 358 days.

(21) Appl. No.: 15/294,716

(22) Filed: Oct. 15, 2016

(65) Prior Publication Data

US 2017/0105451 A1 Apr. 20, 2017

Related U.S. Application Data

(60) Provisional application No. 62/242,927, filed on Oct. 16, 2015, provisional application No. 62/243,748, filed on Oct. 20, 2015.

(51) Int. Cl.
*A24F 47/00* (2020.01)

(52) U.S. Cl.
CPC ..... *A24F 47/008* (2013.01)

(58) Field of Classification Search
CPC ..... A24F 47/008; A24F 40/44; A24F 40/10; A61M 15/0001; A61M 15/06; A61M 15/004; A61M 15/0043; A61M 2205/0272; A61M 11/044; A61M 2016/0024
See application file for complete search history.

(56) References Cited

U.S. PATENT DOCUMENTS 4,836,370 A * 6/1989 Bosshard ..... B65D 51/2828 206/222
5,284,132 A * 2/1994 Geier ..... A61M 11/02 128/200.22
5,381,913 A 1/1995 Peeters
5,593,635 A * 1/1997 Matsumoto ..... A61L 9/02 422/5

(Continued)

FOREIGN PATENT DOCUMENTS

TW 200948677 * 12/2009
WO WO 2016071027 * 5/2016

*Primary Examiner* — Ibrahime A Abraham
*Assistant Examiner* — Gyounghyun Bae
(74) *Attorney, Agent, or Firm* — Flener IP & Business Law; Zareefa B. Flener

(57) ABSTRACT

An assembly, a disposable foil tank, and method for providing a liquid including a plurality of chemicals for vapor administration. The assembly comprising a disposable tank with a first end and a second end, a foil seal, and an airflow ring. The disposable tank includes a first tubular portion and a second tubular portion. The first tubular portion defines a liquid container and a liquid container aperture at the second end of the disposable tank. The second tubular portion defines an air passage and an air passage aperture at the second end of the disposable tank. The foil seal is applied to the second end of the disposable tank, and the foil seal seals the liquid container aperture and the air passage aperture. The airflow ring includes a piercing element, the piercing element operable to puncture the foil seal when the airflow ring is attached to the second end of the disposable tank.

4 Claims, 7 Drawing Sheets

(56) References Cited

U.S. PATENT DOCUMENTS 5,830,548 A * 11/1998 Andersen ..... B28B 1/00 428/36.4
5,921,203 A 7/1999 Gibbs
6,152,986 A * 11/2000 Foller ..... B01D 53/228 95/47
6,169,852 B1 * 1/2001 Liao ..... F22B 1/284 261/142
6,196,413 B1 * 3/2001 Tung ..... B65D 47/0885 215/229
6,829,902 B1 * 12/2004 Claydon ..... B65D 81/3211 62/101
7,874,420 B2 * 1/2011 Coon ..... B65D 81/3222 206/219
8,701,906 B1 4/2014 Anderson
8,960,424 B1 2/2015 Anderson
9,451,792 B1 9/2016 Alima
9,494,314 B2 * 11/2016 Oglesby ..... F23C 6/04
10,034,988 B2 * 7/2018 Wensley ..... A61M 15/06
10,251,421 B2 * 4/2019 Kieslich ..... A24F 47/002
10,272,371 B2 * 4/2019 Lombardo ..... B01D 35/30
2001/0029735 A1 * 10/2001 Miura ..... B01B 1/005 60/512
2005/0056611 A1 * 3/2005 Hakim ..... A61J 9/00 215/11.6
2007/0119727 A1 * 5/2007 Cho ..... B65D 51/2892 206/219
2008/0169354 A1 * 7/2008 Bankers ..... A01M 1/2044 239/6
2009/0127274 A1 * 5/2009 Mueller ..... B65D 51/2864 220/789
2009/0202608 A1 * 8/2009 Alessi ..... A61K 45/06 424/424
2009/0324206 A1 * 12/2009 Young ..... F04B 17/00 392/395
2011/0088566 A1 4/2011 Doxie
2011/0240677 A1 * 10/2011 Dwyer ..... G01F 11/028 222/256
2013/0220316 A1 8/2013 Oglesby et al.
2013/0319967 A1 12/2013 Guo
2014/0186496 A1 * 7/2014 Lombardo ..... B01D 35/30 426/82
2014/0299141 A1 10/2014 Flick
2014/0318559 A1 10/2014 Thorens et al.
2014/0346689 A1 11/2014 Dubief
2014/0353856 A1 12/2014 Dubief
2014/0367354 A1 * 12/2014 Ding ..... B65D 45/305 215/276
2015/0014314 A1 * 1/2015 Takanohashi ..... B67D 7/0266 220/254.1
2015/0114409 A1 * 4/2015 Brammer ..... A24F 40/42 131/329
2015/0181937 A1 7/2015 Dubief et al.
2015/0196057 A1 7/2015 Wu
2015/0327596 A1 * 11/2015 Alarcon ..... A24F 47/008 131/328
2015/0328415 A1 * 11/2015 Minskoff ..... A24F 40/42 128/202.21
2016/0016681 A1 * 1/2016 Heyn ..... B65D 41/045 53/471
2016/0167864 A1 * 6/2016 De Cleir ..... B65D 35/22 206/221
2018/0242639 A1 * 8/2018 Borkovec ..... A24F 47/008

* cited by examiner

ASSEMBLY FOR PROVIDING CHEMICALS FOR SMOKELESS ADMINISTRATION, A DISPOSABLE TANK, AND A METHOD OF USING THE SAME

FIELD OF THE INVENTION

The present invention relates to an assembly for providing chemicals for smokeless administration, a disposable tank, and a method of using the same. More specifically, the invention relates to an assembly utilizing a disposable foil tank, and method of using the assembly in smokeless administration of chemicals via vaporization.

BACKGROUND

Vaporization devices use electrical energy to heat a material to form an inhalable substance. In some example implementations, components of vaporization devices may be characterized as electronic cigarettes, and those electronic cigarettes most preferably incorporate tobacco or marijuana and/or components derived from tobacco or marijuana. Vaporization devices also can be characterized as being vapor-producing articles or medicament delivery articles. Thus, such articles or devices can be adapted so as to provide one or more substances (e.g., flavors and/or pharmaceutical active ingredients) in an inhalable form or state. Alternatively, inhalable substances can be in the form of an aerosol (i.e., a suspension of fine solid particles or liquid droplets in a gas). For purposes of simplicity, the term "vapor" as used herein is meant to include vapors, gases and aerosols of a form or type suitable for human inhalation, whether or not visible, and whether or not of a form that might be considered to be smoke-like.

Vaporization devices typically comprise some combination of a battery, at least one control component (such as a microprocessor, individually or as part of a microcontroller), a heating element (such as an electrical resistance heating element), a liquid chamber for holding a liquid capable of yielding a vapor upon application of sufficient heat, and a mouthpiece or tip for allowing a user to draw upon the vaporization device for inhalation of the vapor.

Some vaporization devices are reusable and other vaporization devices are disposable. In either case, if a user does not intend to use all the liquid in a liquid chamber in one use of the vaporization device, an assembly is needed cover a disposable tank after a foil seal has been punctured. Leakage of the liquid is a waste of material.

SUMMARY OF THE INVENTION

The invention is related to an assembly for providing liquid chemicals in a vaporized state to a user. The assembly comprises a disposable tank with a first end and a second end, a foil seal, and a reservoir sleeve. The disposable tank includes a first tubular portion and a second tubular portion. The first tubular portion defines a liquid container and a liquid container aperture at the second end of the disposable tank. The second tubular portion defines an air passage and an air passage aperture at the second end of the disposable tank. The foil seal is applied to the second end of the disposable tank, and the foil seal seals the liquid container aperture and the air passage aperture. The reservoir sleeve includes a piercing element, the piercing element operable to puncture the foil seal when the reservoir sleeve receives the disposable tank. The invention is also related to a disposable tank The tank comprises a first end and a second end, a first tubular portion, a second tubular portion, and a foil seal. The first tubular portion defines a liquid container and a liquid container aperture at the second end of the disposable tank. The second tubular portion defines an air passage and an air passage aperture at the second end of the disposable tank. The second end of the tank receives the foil seal, and the foil seal seals the liquid container aperture and the air passage aperture. The foil seal is applied to the second end of the disposable tank by of electromagnetic sealing and induction sealing.

The invention is further related to a method of manufacturing a disposable tank. The method includes positioning a second tubular portion, defining an air passage and an air passage aperture, inside of a first tubular portion, defining a liquid container and a liquid container aperture. Next, the method includes filling the liquid container with a chemical. Finally, the method includes applying at least one selected from the group of a separate foil seal and a removable cap with a foil seal to a second end of the disposable tank, the foil seal sealing the air passage aperture and the liquid container aperture. The foil seal is applied to the second end of the disposable tank by a method selected from the group consisting of electromagnetic sealing, induction sealing, and capless induction sealing. The foil seal includes a plurality of layers, the plurality of layers including at least one selected from the group consisting of foil laminate, medical grade plastic, aluminum foil, and polymer-based foil.

DETAILED DESCRIPTION OF THE DRAWINGS

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Accordingly, the detailed discussion herein of one or more embodiments is not intended, nor is to be construed, to limit the metes and bounds of the patent protection afforded the present invention, in which the scope of patent protection is intended to be defined by the claims and equivalents thereof. Therefore, embodiments not specifically addressed herein, such as adaptations, variations, modifications, and equivalent arrangements, should be and are considered to be implicitly disclosed by the illustrative embodiments and claims described herein and therefore fall within the scope of the present invention.

Further, it should be understood that, although steps of various claimed methods may be shown and described as being in a sequence or temporal order, the steps of any such method are not limited to being carried out in any particular sequence or order, absent an indication otherwise. That is, the claimed method steps are considered capable of being carried out in any sequential combination or permutation order while still falling within the scope of the present invention.

Additionally, it is important to note that each term used herein refers to that which a person skilled in the relevant art would understand such term to mean based on the contextual use of such term herein. To the extent that the meaning of a term used herein, as understood by the person skilled in the relevant art based on the contextual use of such term, differs in any way from any particular dictionary definition of such term, it is intended that the meaning of the term as understood by the person skilled in the relevant art should prevail.

Furthermore, a person skilled in the art of reading claimed inventions should understand that "a" and "an" each generally denotes "at least one," but does not exclude a plurality unless the contextual use dictates otherwise. And that the term "or" denotes "at least one of the items," but does not exclude a plurality of items of the list.

Figure 1:
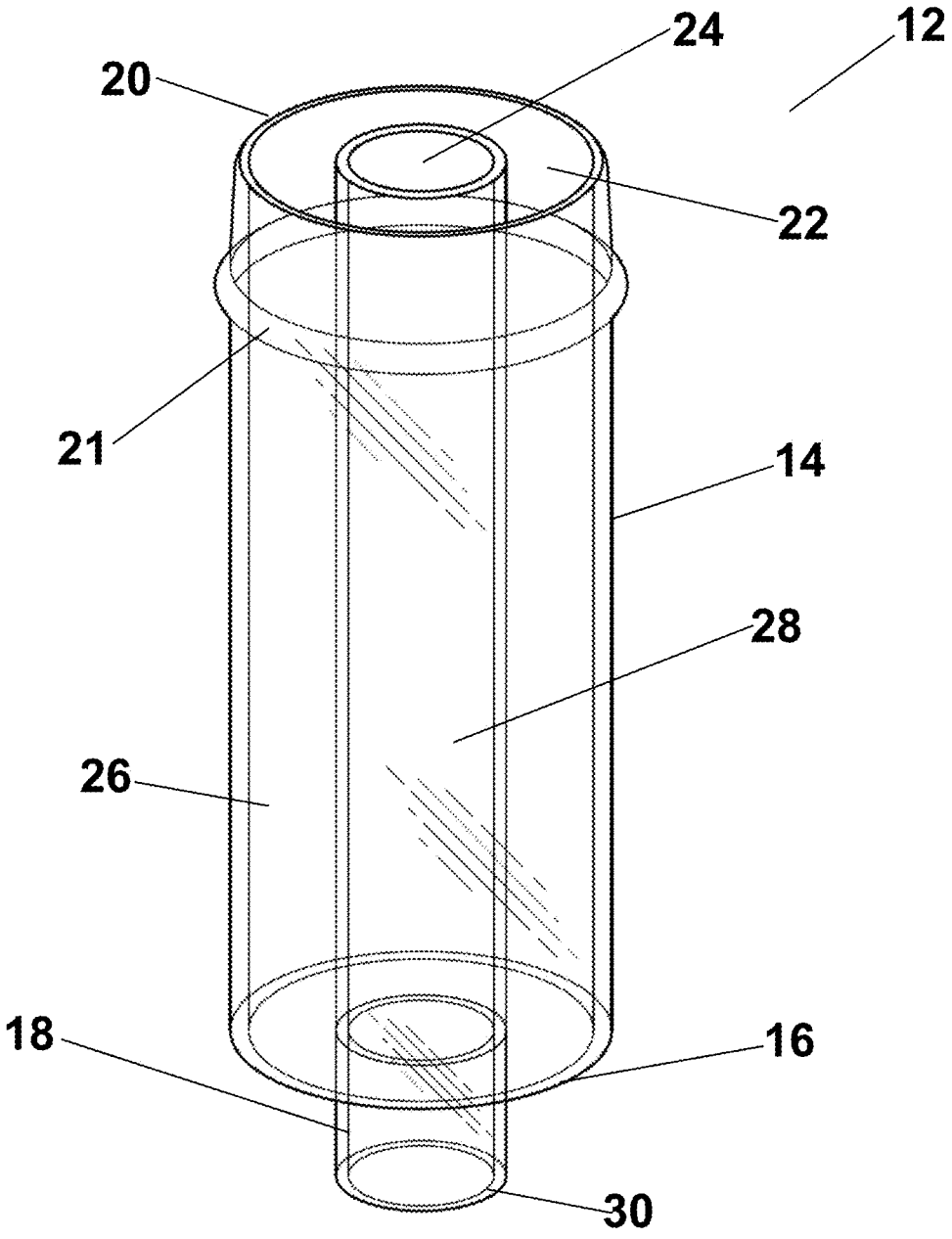
FIG. 1 illustrates an embodiment of the disposable tank of the assembly in accordance with the principles of the present invention.

FIG. 1 illustrates a disposable tank 12 of the assembly 10. The tank 12 has a first tubular portion 14, which abruptly ends at a 90° degree angle contiguous at a first end 16 thereof with a second tubular portion 18, which is much smaller in diameter than the first 14. The second tubular portion 18 terminates at a first end 30 thereof. The first tubular portion 14 defines a liquid container 26 and a liquid container aperture 22 located at a second end 20 of the disposable tank 12. The second tubular portion 18 defines an air passage 28 and an air passage aperture 24 located at the second end 20. In some embodiments, the first tubular portion 14 includes a plurality of lips 21.

Figure 2A:
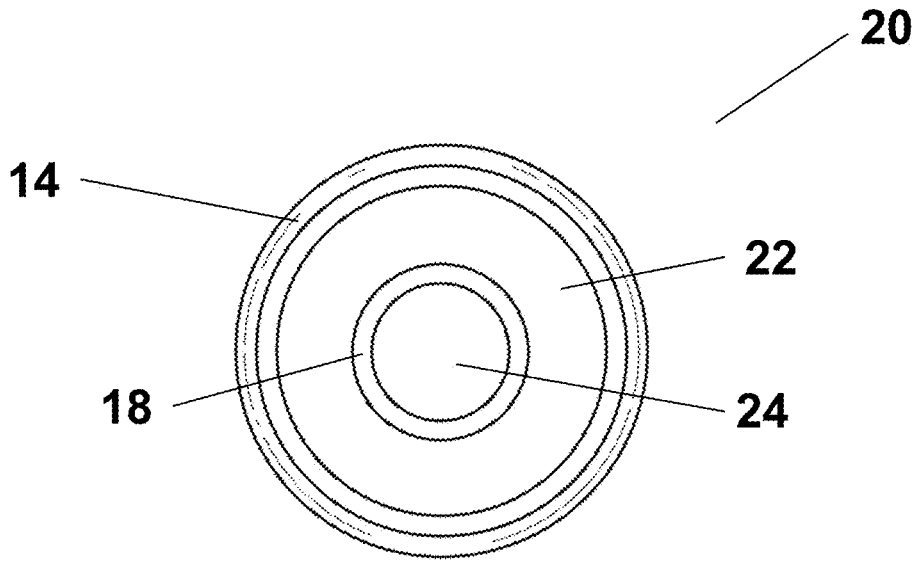
FIG. 2A illustrates an embodiment of the disposable tank of the assembly in accordance with the principles of the present invention.

FIG. 2A illustrates a bottom plan view of the second end 20 of the disposable tank 12. The second tubular portion 18 is housed in the first tubular portion 14. The second tubular portion 18 extends through the first tubular portion 14 to the second end 20 wherein the first tubular portion 14 terminates in the liquid container aperture 22 and the second tubular portion 18 terminates in the air passage aperture 24. The air passage aperture 24 extends through the inside of the disposable tank 12, through the first tubular portion 14, as the air passage 28 illustrated in FIG. 1. The liquid containing aperture 24 accommodates the liquid chemical in the liquid container 26 illustrated in FIG. 1. The liquid chamber 26 can hold, for example, but not limited to, 11.5 mm or 14 mm of liquid. The shape and configuration of the first tubular portion 14 and also the second tubular portion 18, and therefore the first end 30 and the second end 20, can be of any shape and size. The tubular portions 14, 18 are circular and concentric in this embodiment. Non-circular and non-concentric tubes 14, 18 are also possible. The first tubular portion 14 has a single diameter along its length. In other embodiments, the first tubular portion 14 has a variable diameter.

The liquid chemical can be any liquid chemical including, but not limited to nicotine, cannabidiol, tetrahydrocannabinol, a combination thereof, and/or any other chemicals which are known and understood in the art to be effectively delivered by a vaporization system. The disposable tank 12 is a single component design. In other words, the tank 12 is a coil-less tank, wherein a heating coil generally necessary for vaporizing liquid chemicals is not housed in the tank 12. In this way, an operator can merely use the disposable tank 12 and then discard the tank 12 without wasting any vaporization components. By providing a tank 12 that is of a single component design, no foreign materials outside of the molding materials contaminates the tank. Preferably, the molding materials are a medical grade plastic, but could also be any other material that could be used for this purpose.

Figure 2B:
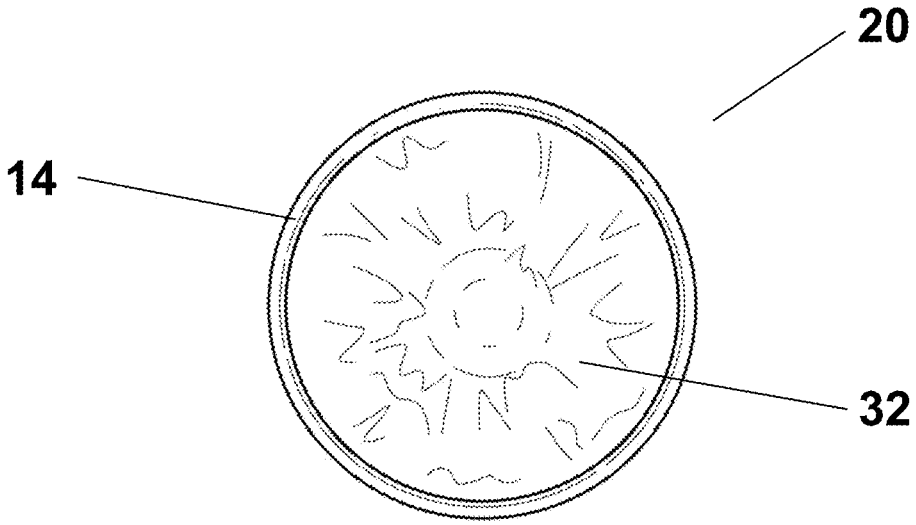
FIG. 2B illustrates an embodiment of the disposable tank with the foil attached in accordance with the principles of the present invention.

The second tubular portion 18 and the first tubular portion 14 is composed of, for example, but not limited to, a glass, a plastic, a metal, an alloy, or a combination of this and other suitable materials known in the art. In a preferred embodiment, the first tubular portion 14 is composed of glass or clear plastic so that a user can see how much liquid is in the liquid chamber 26. In some embodiments, the first tubular portion 14 includes a scale to measure the volume of liquid inside the liquid chamber 26. FIG. 2B illustrates a bottom plan view of a second end 20 of the disposable tank 12. The second end 20 of the disposable tank 12 is fitted with a foil seal 32 by electromagnetically sealing the foil 32 to the tank 12. Specifically, the foil 32 is applied to the first tubular portion 14 at liquid container aperture 22 and the second tubular portion 18 at the air passage aperture 24, thus covering and hermetically sealing the apertures 22, 24. Methods of applying the foil seal 32 to the tank 12 are well known in the art, for example induction "cap" sealing or capless induction sealing. Induction sealing is a non-contact heating process that hermetically welds a foil laminate (called an inner-seal) to the lip of jars and bottles. The sealing process takes place after the filling (and capping, where the process requires a cap) operation. The FDA recognizes induction sealing as an effective means of tamper evidence. In a preferred embodiment, the foil in the foil seal 32 is a medical grade foil. In other embodiments, the foil seal is a plurality of layers, the plurality of layers including, but not limited to, a foil laminate, a medical grade plastic, an aluminum foil, and a polymer-based foil. This closed system design allows for a tamper proof component structure.

The disposable tank 12 is also provided with a cap 34. If the foil seal 32 is accommodated onto the second end 20 of the tank 12 via induction cap sealing then the cap 34 is provided on the inside with a plurality of layers, including aluminum foil and a polymer based film. When processed, the layers from the cap 34 create the foil seal 32 on the tank 12. If capless induction sealing is used, then the cap 34 would not have these layers therein, but rather, the tank 12 would be sealed and accommodate the foil seal 32 before the addition of the cap 34. The material from which the disposable tank 12 (the tubular portions 14, 18) is made, therefore, must be any material to which a foil seal 32 can adhere via an induction sealing process, including, but not limited to plastic and glass.

Figure 3:
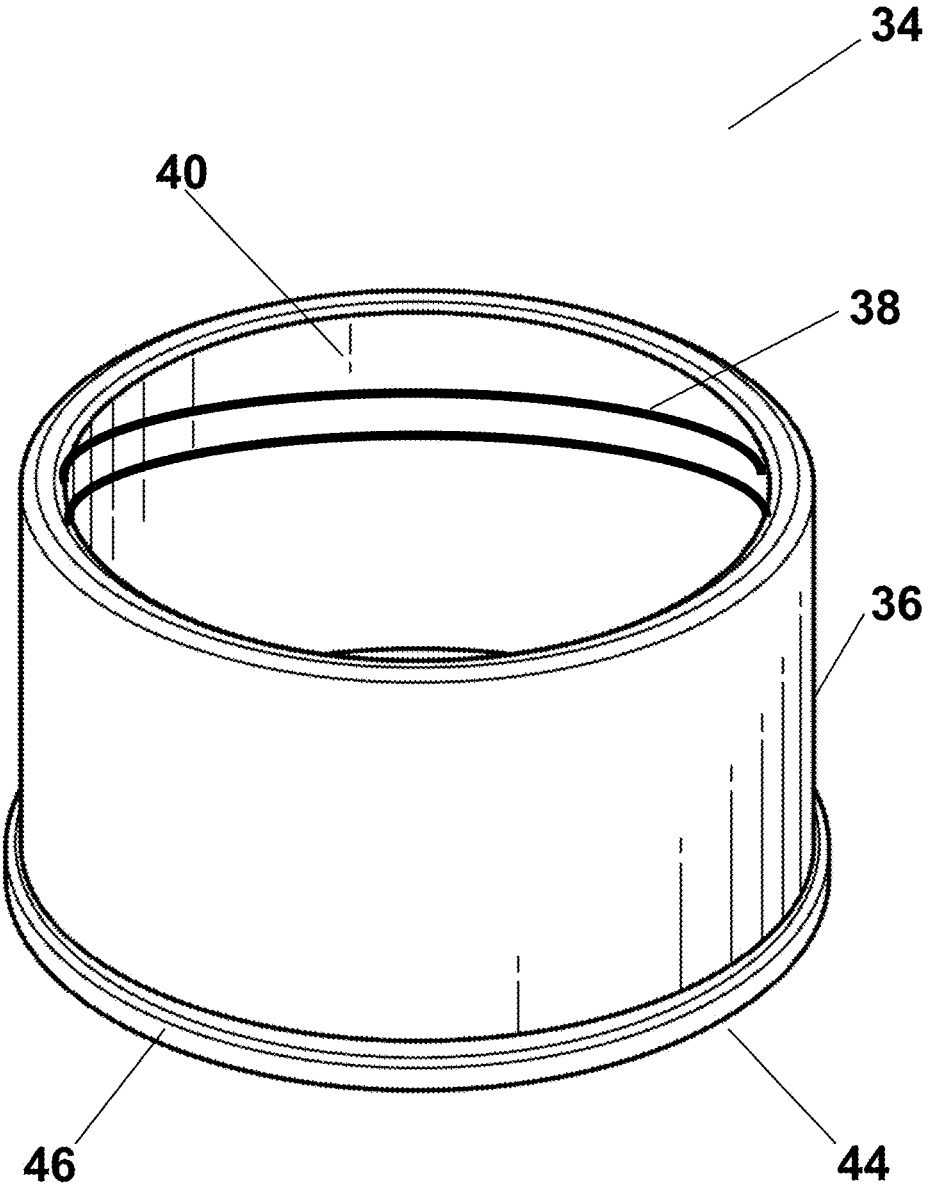
FIG. 3 illustrates an embodiment of the cap of the assembly in accordance with the principles of the present invention.

FIG. 3 illustrates the cap 34 of the tank 12. The cap 34 has a diameter slightly wider than that of the second end 20 of the tank 12 whereby the cap 34 can be fitted over and accommodate the tank 12 in the cap aperture 36.

In order to provide a more secure fit, the tank 12 can have a plurality of lips 21 to accommodate a plurality of grooves 38 on the cap 34. In the alternative, the plurality of lips 21 can be on the cap 34 while the plurality of grooves 38 can be on the tank 12. Illustrated in FIG. 3 is a plurality of grooves 38 on an inside wall 40 of the cap 34. Correspondingly, the disposable tank 12 has a tank lip 21 surrounding the second end 20 of the tank 12 (see FIG. 1). When the cap 34 is accommodated onto the disposable tank 12, the lip 21 of the tank 12 accommodates the plurality of grooves 38 on the cap 34 thereby securing the cap 34 in place. It is not necessary that the lip 21 be a single lip 21, just as long as the lip 21 is accommodated by the corresponding groove(s) 38. The cap 34 also has at a top 44 of the cap 44 a rim 46. The rim 46 provides the top 44 of the cap with a slightly wider diameter than the wall 36 so that removal of the cap is easily accomplished merely by pushing the rim 46 away from the tank 12.

The removable cap 34 is composed of, for example, but not limited to, silicone, rubber, a metal, or an alloy. The cap 34 may be attached to the tank 12 during manufacturing. A user removes the cap 34 when ready to use the disposable tank 12.

In use, when the foil seal 32 has been punctured allowing access to the liquid chemicals in the liquid container 26, in the event that the chemicals are not depleted in operation, the cap 34 can be re-accommodated onto the tank 12 whereby an inside surface 42 of the top of the cap 44 is pressed against the air passage aperture 24 thereby blocking the air passage 28 and is also pressed against the liquid container aperture 22 whereby the chemical(s) containing liquid in the liquid container 26 is also blocked. The cap 34 remains securely in place due to the lip and groove accommodation between the cap 34 and the tank 12. This re-accommodation of the cap 34 onto the tank 12 provides for re-use, while at the same time, provides a safe and non-messy storage solution.

Figure 4:
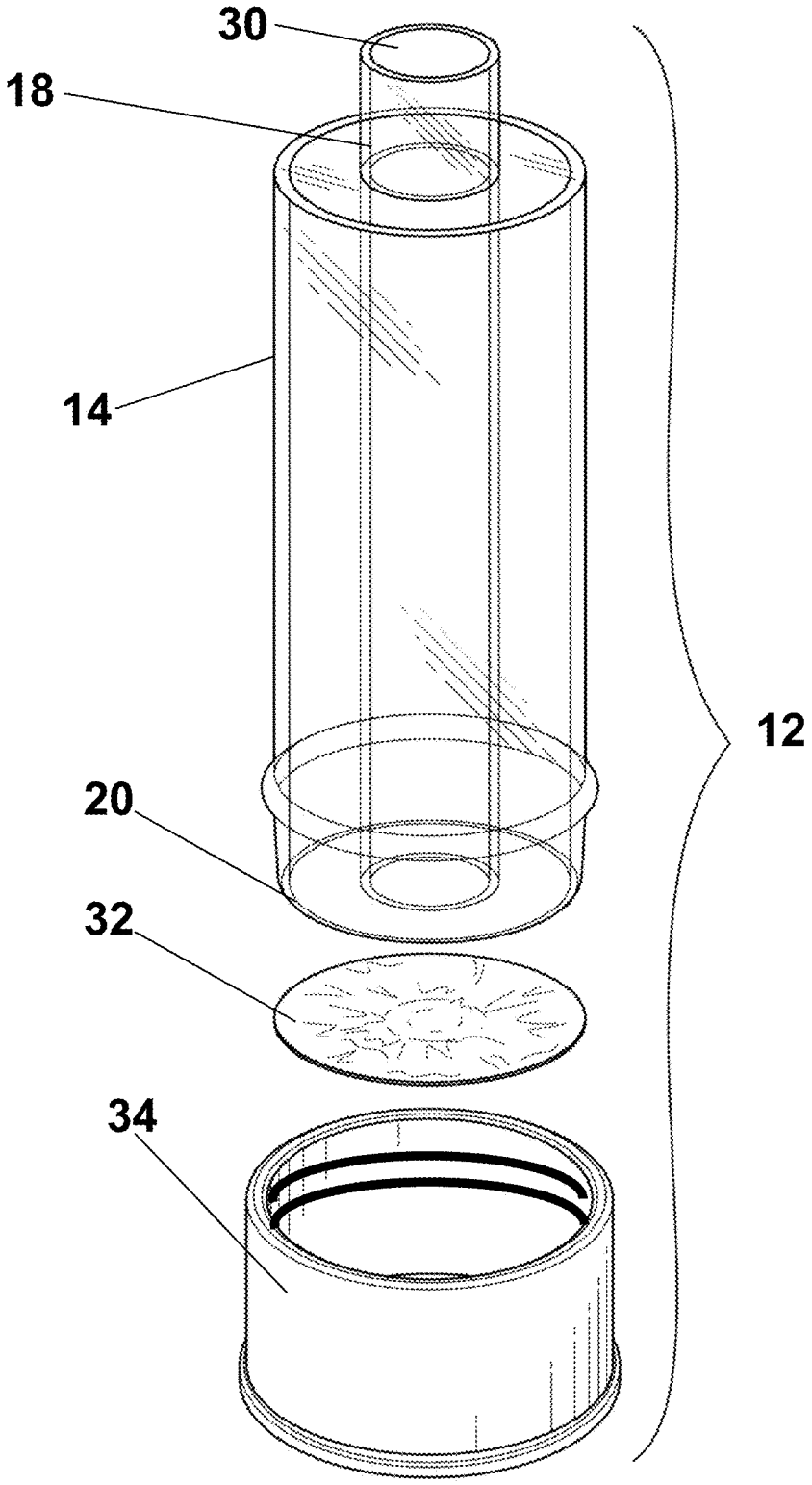
FIG. 4 illustrates an assembly view of the disposable tank with the foil and the cap in accordance with the principles of the present invention.

FIG. 4 illustrates an assembly view of the disposable tank 12 with the foil seal 32 and the cap 34. The tubular portions 14, 18 are assembled. The second end 20 receives the foil seal 32. The cap is positioned over the second end and the foil seal 32. As discussed above with respect to FIG. 2B, the foil seal 32 can be applied separately or simultaneously with the cap 34 during manufacture (after the liquid container 26 has been filled with a chemical). The is foil seal 32 applied to the second end 20 of the disposable tank 12 by a method selected from the group consisting of electromagnetic sealing, induction sealing, and capless induction sealing. The foil seal 32 may include a plurality of layers, the plurality of layers including, but not limited to, a foil laminate, medical grade plastic, aluminum foil, and polymer-based foil.

Figure 5:
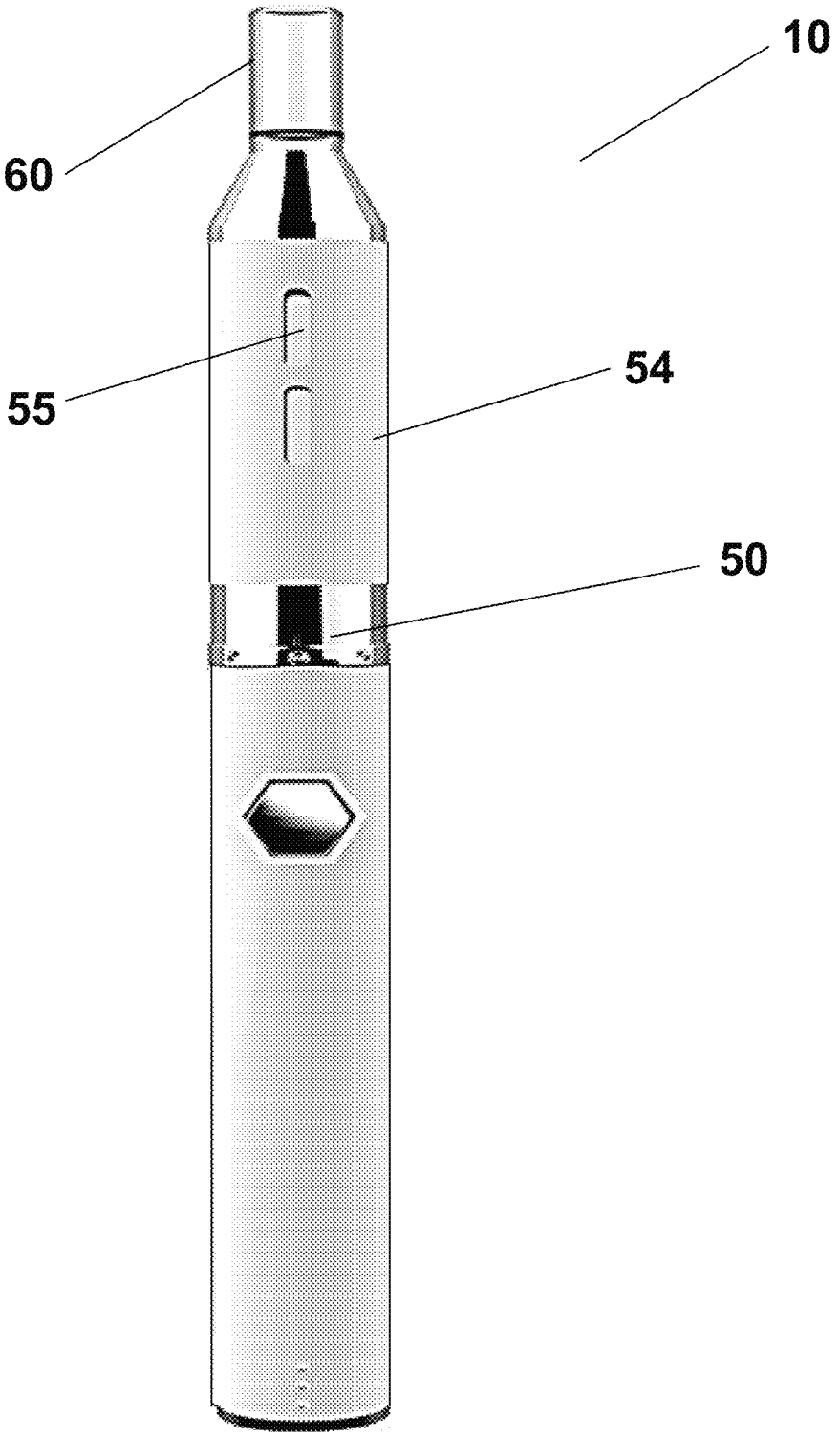
FIG. 5 illustrates an embodiment of the disposable assembly in accordance with the principles of the present invention.
Figure 6:
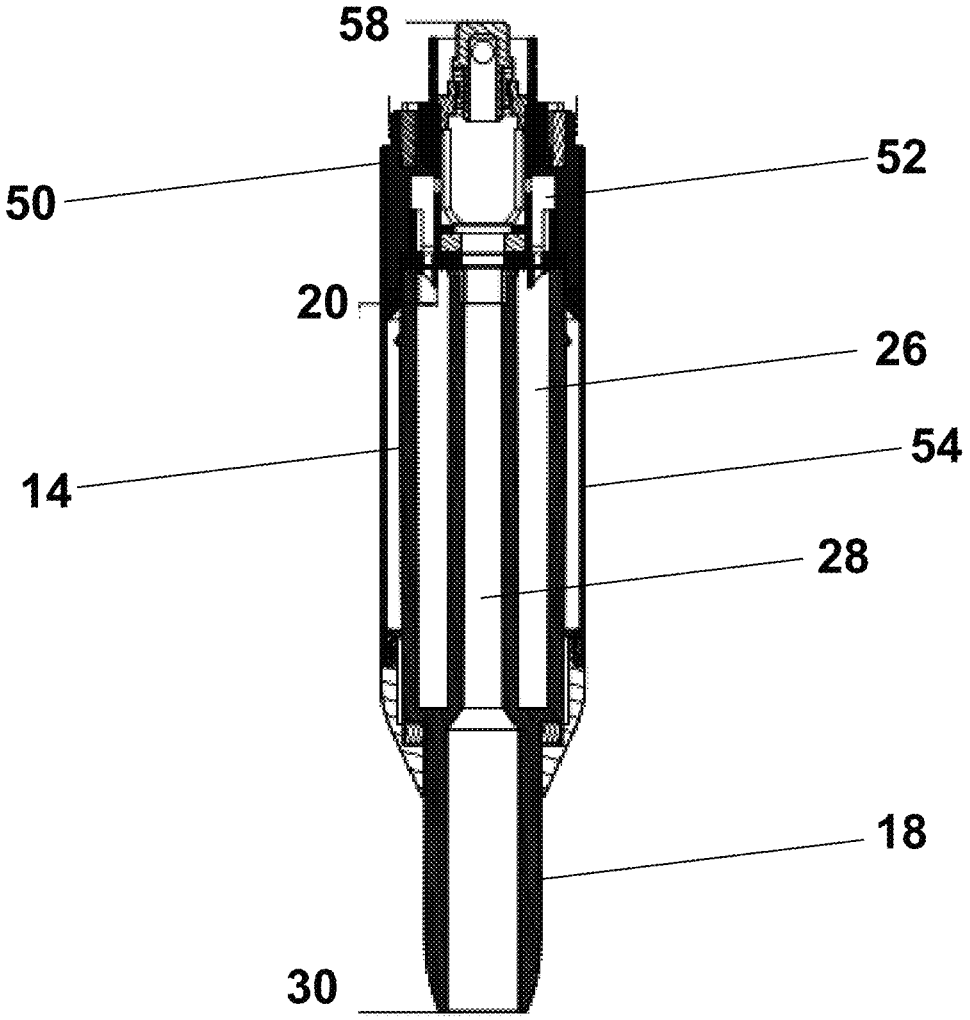
FIG. 6 illustrates a cross section of an embodiment of the assembly in accordance with the principles of the present invention.

When assembled, the second end 20 of the tank 12 is accommodated by a reservoir sleeve 54, as seen in FIG. 5. In use, the tank 12 is inserted into the reservoir sleeve 54 whereby a plurality of piercing elements 52 puncture the foil seal 32, provided in FIG. 6. In some embodiments, the reservoir sleeve 54 includes at least one window 55. These piercing elements 52 deliver the liquid chemicals from the tank 12 to a vaporizer 58, thereby providing a consistent and even flow of liquid chemicals to the vaporizer 58. The vaporizer 58 can include heating elements made of any material known in the art to effectively heat liquid chemicals, for example, including nickel or a nickel alloy. The vaporizer 58 and other components of vaporization devices, such as batteries and control components, are attached and/or integrated with the reservoir sleeve 54 and/or an adjustable airflow ring 50. Operation of vaporizers and other components of vaporization devices, such as batteries and control components, are known to a person skilled in the art.

In the assembly 10 includes an adjustable airflow ring 50. The adjustable air flow ring 50 can be adjusted by turning the same to reveal or obscure air vents 56 along the side of the assembly 10 for the user to adjust the flow of air through the air passage 28 and to the user.

The first end 30 of the tank 12 is affixed to a guard 60, which further extends the air passage 28 to a mouthpiece. The guard 60 protects the air passage 28 from contamination at the first end 16 by enclosing the same inside the reservoir sleeve 54. The reservoir sleeve is provided at the first end 16 with threading to affix the guard 60 thereto. Moreover, in an embodiment, also provided is an air passage cap to go over the air passage 28 at the mouthpiece. An embodiment of the cap can include a sanitizer by which the first end 16, including the mouthpiece, is cleaned with antibacterial and/or anti viral solution including, for example, but not limited to, exposing the same to cleansing alcohol. In a particular embodiment, the air passage cap of the guard 60 contains a material which can be doused with alcohol, for example by applying a few drops, and can be contained within a flap. In this way, the alcohol can clean the mouthpiece end of the air passage 28, while at the same time, the flap of the guard 60 prevents the sanitizer from completely drying out through exposure to air. Rather, the first end 30 is cleaned by the sanitizer housed in the guard 60. In this way, the assembly can be kept clean for patients using the same for medicinal delivery of chemicals thereby reducing the risks of infection with multiple uses.

Also of note is that after use, if there remains some liquid in the tank 12, the disposable tank 12 can be removed from the plurality of piercing elements 52, and the cap 34 re-applied, and the tank 12 stored for re-use at a later time and/or day. The re-capped tank 12 is safe from spillage because the cap 34 blocks the liquid container aperture 22 leading to the liquid container 26. Moreover, the plurality of lip(s) 21 and groove(s) 38 feature on the cap 34 and tank 12 allow for a secure fit thereby preventing the movement of the cap 34 and the spilling of the liquid chemical(s). This is not only cleaner and cost conscious, but also provides for a more hygienic solution for storage.

Figure 7A:
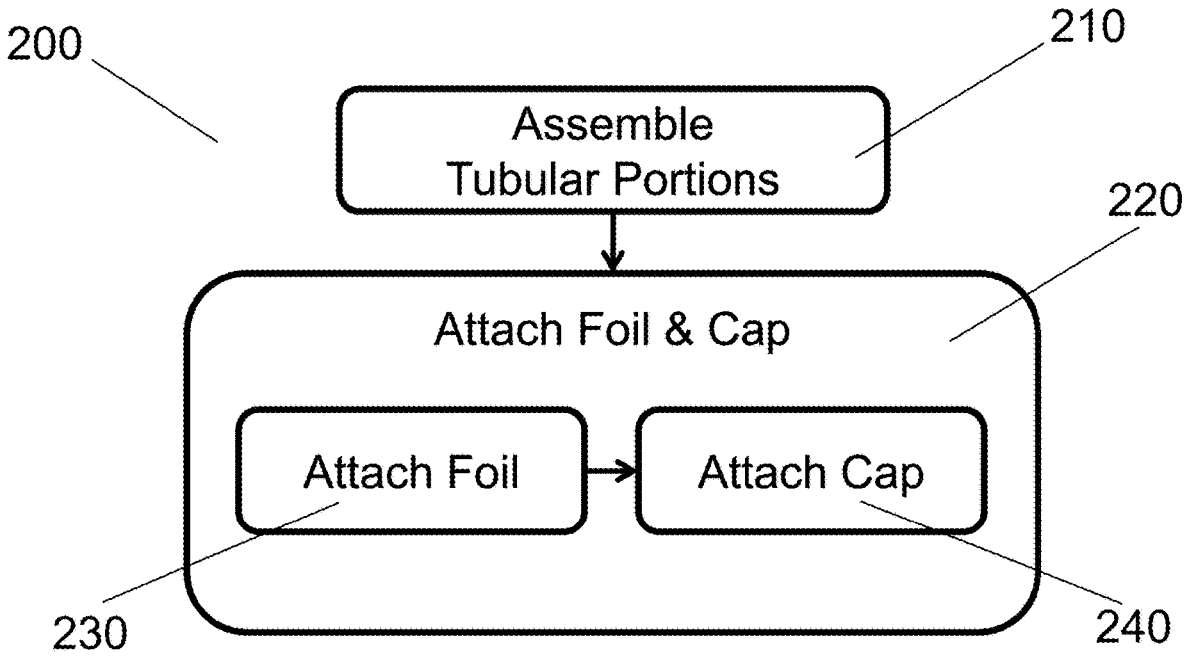
FIG. 7A illustrates a process for manufacturing the disposable tank in accordance with the principles of the present invention.

FIG. 7A illustrates a process 200 for manufacturing the disposable tank 12 in accordance with the principles of the present invention. At step 210, the tubular portions 14, 18 are assembled. The second tubular portion 18 is positioned inside of the first tubular portion 14. Once the tubular portions are assembled, the liquid container 26 is filled with a liquid chemical. At step 220, the foil seal 32 and the removable cap 34 are attached. As described above with respect to FIGS. 2A, 3, and 4, the foil seal 32 may be separately attached to the tank 12 or attached as part of the removable 34. When attached separately, the foil seal 32 is first applied to the tubular portions 14, 18 at the second end 20, thus covering the apertures 22, 24. The foil seal 32 is applied to the second end 20 by a method of, for example, but not limited to, electromagnetic sealing and capless induction sealing, Then the removable cap is attached in step 240. The plurality of grooves 38 on the cap 34 receives the plurality of lips 21 on the first tubular portion 14.

If the foil seal 32 is inside the cap aperture 36 of the removable cap 34, the seal 32 and the cap 34 are attached simultaneously to the second end 20 of the tank 12. The foil seal 32 is applied to the second end 20 by a method of, for example, but not limited to, electromagnetic sealing and induction sealing. The plurality of grooves 38 on the cap 34 receives the plurality of lips 21 on the first tubular portion 14, or vice versa.

Figure 7B:
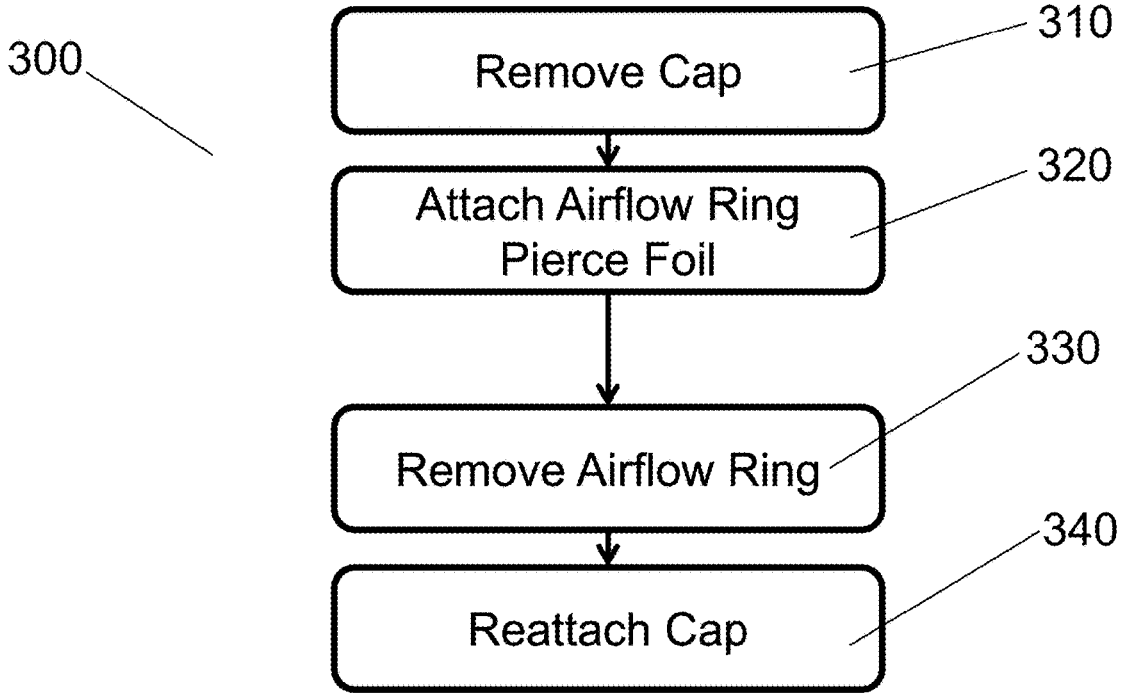
FIG. 7B illustrates a process for using the disposable tank in accordance with the principles of the present invention.

FIG. 7B illustrates a process 300 for using the disposable tank 12 in accordance with the principles of the present invention. At step 310, The user removes the cap 34 if it is provided by the manufacturer of the disposable tank 12. The user then attaches the airflow ring 50 and/or reservoir sleeve 54 to the second end 20 at step 320. Piercing elements 52 of the ring 50 and/or sleeve 54 puncture the foil seal 32. Puncturing the foil seal 32 allows a liquid chemical to enter a vaporizer. At step 330, after completion of use of the disposable tank 12 with the assembly 10, but with remaining liquid chemical, the user removes the airflow ring 50 and/or reservoir sleeve 54. The user reattaches the removable cap 34 to the second end 20 of the disposable tank 12 at step 340, thus reducing preserving the remaining liquid chemical.

As to the manner of usage and operation of additional components of the present invention, such as a vaporizer, control components, and batteries, the same should be apparent from the above description. Accordingly, no further discussion relating to the manner of usage and operation will be provided.

While a preferred embodiment of the disposable tank and the disposable assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable tank for an assembly in smokeless administration of chemicals via vaporization comprising:

a first tubular portion having a closed first tubular first end and an open first tubular second end;

one or more of a plurality of lips disposed around an exterior surface of the first tubular portion proximate to the open first tubular second end; and a second tubular portion having an open second tubular first end and an open second tubular second end and housed within the first tubular portion; and a foil seal disposed over the open first tubular second end and the open second tubular second end; wherein the second tubular portion extends through the closed first tubular first end.

2. The disposable tank of claim 1, wherein the foil seal comprises one or more of layers of material selected from the group of material consisting of foil laminate, medical grade plastic, aluminum foil, polymer-based foil, and combinations thereof.

3. The disposable tank of claim 1, further comprising a removable cap having an open removable cap end and a closed removable cap end and one or more of a plurality of grooves circumferentially disposed around an interior surface of the removable cap, wherein the one or more of the plurality of grooves is adapted to accommodate the one or more of the plurality of lips to secure the removable cap over the first tubular second end.

4. The disposable tank of claim 3, wherein the removable cap further comprises a rim disposed around an exterior surface of the removable cap proximate to the closed removable cap end.

* * * * *